US009759035B2

(12) United States Patent
Fripp et al.

(10) Patent No.: US 9,759,035 B2
(45) Date of Patent: Sep. 12, 2017

(54) METHODS OF REMOVING A WELLBORE ISOLATION DEVICE USING GALVANIC CORROSION OF A METAL ALLOY IN SOLID SOLUTION

(71) Applicant: HALLIBURTON ENERGY SERVICES, INC., Houston, TX (US)

(72) Inventors: Michael L. Fripp, Carrollton, TX (US); Zachary W. Walton, Carrollton, TX (US); Zachary R. Murphree, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 197 days.

(21) Appl. No.: 14/199,820

(22) Filed: Mar. 6, 2014

(65) Prior Publication Data

US 2014/0190705 A1 Jul. 10, 2014

Related U.S. Application Data

(63) Continuation-in-part of application No. 13/491,995, filed on Jun. 8, 2012, now Pat. No. 8,905,147, and a (Continued)

(51) Int. Cl.
*E21B 34/06* (2006.01)
*E21B 33/12* (2006.01)

(52) U.S. Cl.
CPC ..... *E21B 33/1208* (2013.01); *E21B 33/12* (2013.01); *E21B 34/063* (2013.01)

(58) Field of Classification Search
CPC ..... E21B 29/00; E21B 34/063; E21B 34/14
See application file for complete search history.

(56) References Cited

U.S. PATENT DOCUMENTS 3,876,471 A 4/1975 Jones
4,573,517 A 3/1986 Booth et al.
(Continued)

FOREIGN PATENT DOCUMENTS

CA 2857123 6/2013
EP 2354436 A2 8/2011
(Continued)

OTHER PUBLICATIONS

T.Tanski, Synergy effect of heat and surface treatment on properties of the Mg—Al—Zn cast alloys, Journal of Achievements in Materials and Manufacturing Engineering, Oct. 2012, p. 260-274, vol. 54, Issue 2, Silesian University of Technology, Giliwice, Poland.
Degradable Casing Perforation Ball Sealers and Methods for Use in Well Treatment, IPCOM000215741D, Mar. 7, 2012. Available at: http://priorartdatabase.com/IPCOM/000215741.
(Continued)

*Primary Examiner* — Jennifer H Gay
*Assistant Examiner* — Steven MacDonald
(74) *Attorney, Agent, or Firm* — McGuireWoods LLP

(57) ABSTRACT

At least a portion of a wellbore isolation device consists essentially of: a metal alloy, wherein the metal alloy: (A) comprises magnesium at a concentration of at least 50% by volume of the metal alloy; and (B) at least partially dissolves in the presence of an electrolyte. A method of removing the wellbore isolation device comprises: contacting or allowing the wellbore isolation device to come in contact with an electrolyte; and allowing at least a portion of the metal alloy to dissolve.

19 Claims, 2 Drawing Sheets

Related U.S. Application Data continuation-in-part of application No. PCT/US2013/027531, filed on Feb. 23, 2013.

(56) References Cited

U.S. PATENT DOCUMENTS

| | | | | |
|---|---|---|---|---|
| 5,570,502 | A | 11/1996 | Sawtell et al. | |
| 5,578,255 | A | 11/1996 | Okuyama et al. | |
| 7,077,200 | B1 | 7/2006 | Adnan et al. | |
| 7,350,582 | B2 | 4/2008 | McKeachnie et al. | |
| 7,699,101 | B2 | 4/2010 | Fripp et al. | |
| 7,708,937 | B2 * | 5/2010 | Meng | C22C 23/04 148/420 |
| 7,798,236 | B2 | 9/2010 | McKeachnie et al. | |
| 8,211,248 | B2 | 7/2012 | Marya | |
| 8,413,727 | B2 | 4/2013 | Holmes | |
| 8,424,610 | B2 | 4/2013 | Newton et al. | |
| 8,573,295 | B2 | 11/2013 | Johnson et al. | |
| 2004/0045715 | A1 | 3/2004 | Stoesz et al. | |
| 2005/0205265 | A1 | 9/2005 | Todd et al. | |
| 2007/0089877 | A1 | 4/2007 | Corre et al. | |
| 2007/0107908 | A1 | 5/2007 | Vaidya et al. | |
| 2007/0181224 | A1 * | 8/2007 | Marya | C09K 8/805 148/400 |
| 2008/0066924 | A1 | 3/2008 | Xu | |
| 2008/0149351 | A1 | 6/2008 | Marya et al. | |
| 2008/0175744 | A1 * | 7/2008 | Motegi | C22C 23/02 420/409 |
| 2008/0249637 | A1 | 10/2008 | Asgari | |
| 2009/0025940 | A1 | 1/2009 | Rytlewski | |
| 2009/0101334 | A1 | 4/2009 | Baser et al. | |
| 2010/0270031 | A1 | 10/2010 | Patel | |
| 2010/0294510 | A1 | 11/2010 | Holmes | |
| 2011/0132619 | A1 | 6/2011 | Agrawal | |
| 2011/0132621 | A1 | 6/2011 | Agrawal et al. | |
| 2011/0136707 | A1 | 6/2011 | Xu et al. | |
| 2011/0186306 | A1 | 8/2011 | Marya et al. | |
| 2012/0118583 | A1 | 5/2012 | Johnson et al. | |
| 2012/0175109 | A1 | 7/2012 | Richard | |
| 2012/0318513 | A1 * | 12/2012 | Mazyar | C25D 5/48 166/304 |
| 2013/0032357 | A1 | 2/2013 | Mazyar et al. | |
| 2013/0081814 | A1 | 4/2013 | Gaudette et al. | |
| 2013/0133897 | A1 | 5/2013 | Baihly et al. | |
| 2013/0146302 | A1 | 6/2013 | Gaudette et al. | |
| 2013/0153236 | A1 | 6/2013 | Bishop | |
| 2013/0206425 | A1 | 8/2013 | Mazyar et al. | |
| 2013/0209175 | A1 | 8/2013 | Keyworth | |
| 2013/0240200 | A1 | 9/2013 | Frazier | |
| 2013/0269932 | A1 | 10/2013 | Dams et al. | |
| 2013/0300066 | A1 | 11/2013 | Xu et al. | |
| 2013/0327540 | A1 | 12/2013 | Hamid et al. | |
| 2013/0333899 | A1 | 12/2013 | Xu | |
| 2014/0027128 | A1 | 1/2014 | Johnson et al. | |
| 2014/0196899 | A1 | 7/2014 | Jordan et al. | |

FOREIGN PATENT DOCUMENTS

| | | | |
|---|---|---|---|
| EP | 21188437 | B1 | 3/2012 |
| WO | 2007141465 | A1 | 12/2007 |
| WO | WO 2011017047 | A1 | 2/2011 |
| WO | WO 2012/091984 | A2 | 7/2012 |
| WO | WO 2013019409 | A2 | 2/2013 |
| WO | WO2013089941 | A1 | 6/2013 |

OTHER PUBLICATIONS

Solu-Plugs—Delayed Frac Plugs, IPCOM000176055D, Nov. 3, 2008. Available at: http://www.ip.com/pubview/IPCOM000176055D.

International Search Report and Written Opinion dated Mar. 31, 2015; PCT International Application No. PCT/US2014/068438.

International Written Opinion dated May 27, 2015; PCT International Application No. PCT/US2015/014981.

International Search Report and Written Opinion dated May 19, 2015; PCT International Application No. PCT/US2015/014988.

European Patent Office, Communication, European extended search report, Application No. 13801386.7, dated May 30, 2016.

Australian Government IP Australia; Patent Examination Report No. 2; dated Apr. 29, 2016.

Australian Patent Office, Patent Examination Report No. 1, Australian Application No. 2015248171, dated Sep. 6, 2016.

Australian Patent Office, Patent Examination Report No. 1, Australian Application No. 2014377594, dated Jul. 21, 2016.

Patent Office of the Cooperation Council for the Arab States of the Gulf, Examination Report, Application No. GC2013-24222, dated Aug. 18, 2016.

Australian Patent Office, Patent Exam Report No. 2, Australian Application No. 2014377594, dated Sep. 29, 2016.

European Patent Office, Communication pursuant to Rules 161(2) and 162 EPC, European Application No. 14878579.3, dated Jun. 3, 2016.

PCT, International Search Report and Written Opinion, PCT Application No. PCT/US2014/068372, dated Mar. 19, 2015.

Australian Patent Office, Patent Exam Report No. 1, Australian Application No. 2014385212, dated Jul. 14, 2016.

European Patent Office, Communication pursuant to Rules 161(2) and 162 EPC, European Application No. 14884707.2, dated Jun. 16, 2016.

Australian Patent Office, Patent Exam Report No. 1, Australian Application No. 2014385213, dated Aug. 11, 2016.

Australian Patent Office, Patent Exam Report No. 2, Australian Application No. 2014385213, dated Oct. 12, 2016.

European Patent Office, Communication pursuant to Rules 161(2) and 162 EPC, European Application No. 14884808.8, dated Jun. 21, 2016.

PCT, International Search Report and Written Opinion, PCT Application No. PCT/US2013/027531, dated Dec. 9, 2014.

Patent Office of the Cooperation Council for the Arab States of the Gulf, Examination Report, GC Application No. 2013-24222, dated May 11, 2016.

PCT, International Search Report and Written Opinion, PCT Application No. PCT/US2014/068442, dated Mar. 19, 2015.

European Patent Office, Communication pursuant to Rules 161(2) and 162 EPC, European Application No. 15780083.0, dated Oct. 26, 2016.

Canadian Intellectual Property Office, Office Action, Canadian Application No. 2,868,885, dated Jan. 20, 2016.

Canadian Intellectual Property Office, Office Action, Canadian Application No. 2,868,885, dated Oct. 27, 2016.

European Patent Office, Communication, Appln. No. 14878579.3, dated Apr. 25, 2017.

European Patent Office, Supplementary European Search Report, Appln. 14884707.2, dated Jun. 29, 2017.

Canadian Intellectual Property Office, Office Action, Appln. 2,933,023, dated May 31, 2017.

* cited by examiner

METHODS OF REMOVING A WELLBORE ISOLATION DEVICE USING GALVANIC CORROSION OF A METAL ALLOY IN SOLID SOLUTION

TECHNICAL FIELD

An isolation device and methods of removing the isolation device are provided. The isolation device includes a metal alloy in a solid solution that is capable of dissolving via galvanic corrosion in the presence of an electrolyte. According to an embodiment, the isolation device is used in an oil or gas well operation. Several factors can be adjusted to control the rate of dissolution of the metal alloy in a desired amount of time.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
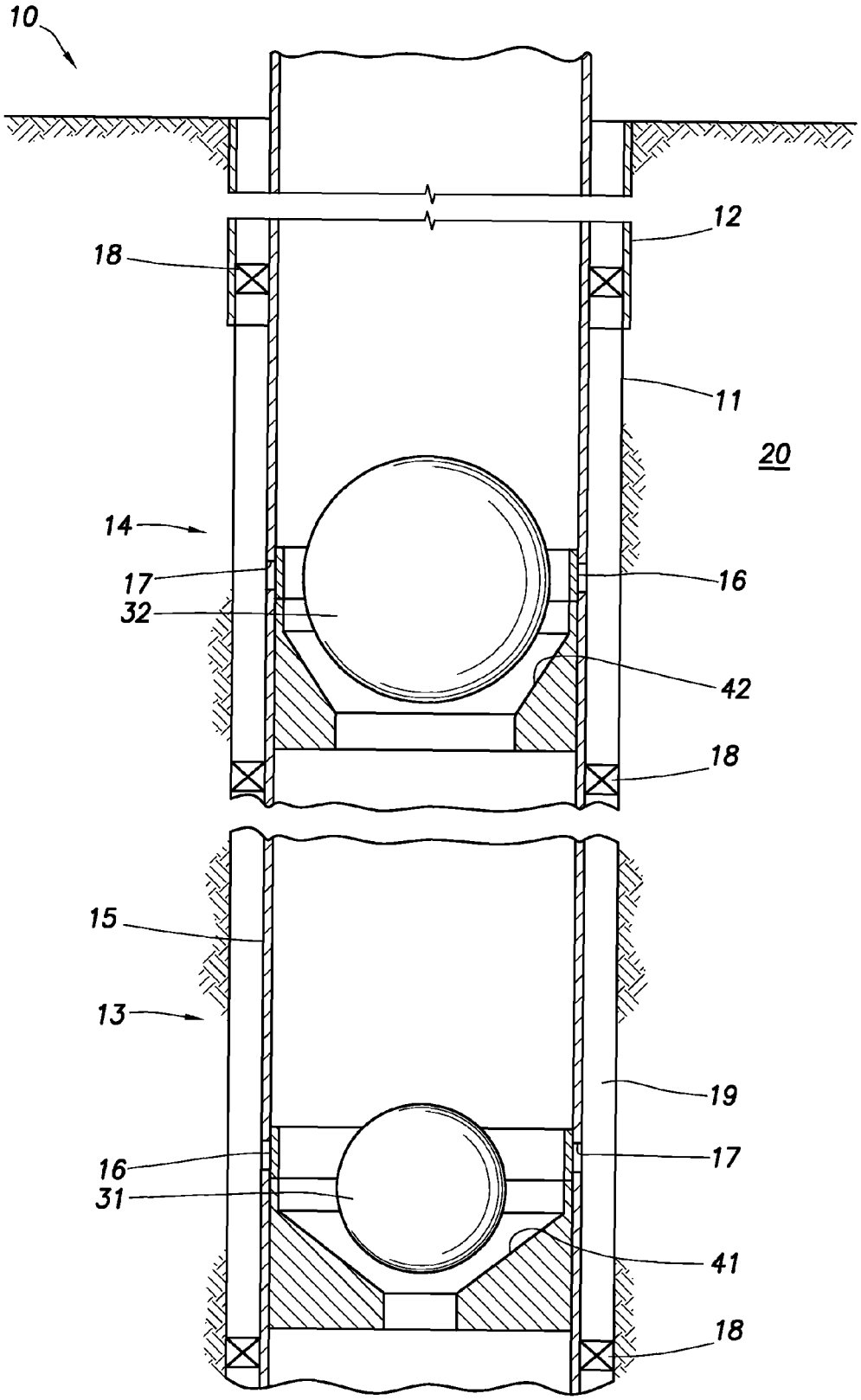
FIG. 1 depicts a well system containing more than one isolation device.

As used herein, the words "comprise," "have," "include," and all grammatical variations thereof are each intended to have an open, non-limiting meaning that does not exclude additional elements or steps. As used herein, the words "consisting essentially of," and all grammatical variations thereof are intended to limit the scope of a claim to the specified materials or steps and those that do not materially affect the basic and novel characteristic(s) of the claimed invention. For example, the portion of the wellbore isolation device can consist essentially of the metal alloy. The portion of the wellbore isolation device can contain other ingredients, such as a coating on the metal alloy, so long as the presence of the other ingredients do not materially affect the basic and novel characteristics of the claimed invention, i.e., so long as the metal alloy dissolves in the presence of an electrolyte.

It should be understood that, as used herein, "first," "second," "third," etc., are arbitrarily assigned and are merely intended to differentiate between two or more isolation devices, wellbore intervals, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device to create multiple wellbore intervals. At least one wellbore interval corresponds to a formation zone. The isolation device can be used for zonal isolation and functions to block fluid flow within a tubular, such as a tubing string, or within an annulus. The blockage of fluid flow prevents the fluid from flowing across the isolation device in any direction and isolates the zone of interest. In this manner, treatment techniques can be performed within the zone of interest.

Common isolation devices include, but are not limited to, a ball and a seat, a bridge plug, a packer, a plug, and wiper plug. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished via a ball and seat by dropping or flowing the ball from the wellhead onto the seat that is located within the wellbore. The ball engages with the seat, and the seal created by this engagement prevents fluid communication into other wellbore intervals downstream of the ball and seat. As used herein, the relative term "downstream" means at a location further away from a wellhead. In order to treat more than one zone using a ball and seat, the wellbore can contain more than one ball seat. For example, a seat can be located within each wellbore interval. Generally, the inner diameter (I.D.) of the ball seats is different for each zone. For example, the I.D. of the ball seats sequentially decreases at each zone, moving from the wellhead to the bottom of the well. In this manner, a smaller ball is first dropped into a first wellbore interval that is the farthest downstream; the corresponding zone is treated; a slightly larger ball is then dropped into another wellbore interval that is located upstream of the first wellbore interval; that corresponding zone is then treated; and the process continues in this fashion—moving upstream along the wellbore—until all the desired zones have been treated. As used herein, the relative term "upstream" means at a location closer to the wellhead.

A bridge plug is composed primarily of slips, a plug mandrel, and a rubber sealing element. A bridge plug can be introduced into a wellbore and the sealing element can be caused to block fluid flow into downstream intervals. A packer generally consists of a sealing device, a holding or setting device, and an inside passage for fluids. A packer can be used to block fluid flow through the annulus located between the outside of a tubular and the wall of the wellbore or inside of a casing.

Isolation devices can be classified as permanent or retrievable. While permanent isolation devices are generally designed to remain in the wellbore after use, retrievable devices are capable of being removed after use. It is often desirable to use a retrievable isolation device in order to restore fluid communication between one or more wellbore intervals. Traditionally, isolation devices are retrieved by inserting a retrieval tool into the wellbore, wherein the retrieval tool engages with the isolation device, attaches to the isolation device, and the isolation device is then removed from the wellbore. Another way to remove an isolation device from the wellbore is to mill at least a portion of the device or the entire device. Yet, another way to remove an isolation device is to contact the device with a solvent, such as an acid, thus dissolving all or a portion of the device.

However, some of the disadvantages to using traditional methods to remove a retrievable isolation device include: it can be difficult and time consuming to use a retrieval tool; milling can be time consuming and costly; and premature dissolution of the isolation device can occur. For example, premature dissolution can occur if acidic fluids are used in the well prior to the time at which it is desired to dissolve the isolation device.

Galvanic corrosion can be used to dissolve a portion or all of an isolation device. Galvanic corrosion occurs when two different metals or metal alloys are in electrical connectivity with each other and both are in contact with an electrolyte. As used herein, the phrase "electrical connectivity" means that the two different metals or metal alloys are either touching or in close enough proximity to each other such that when the two different metals are in contact with an electrolyte, the electrolyte becomes electrically conductive and ion migration occurs between one of the metals and the other metal, and is not meant to require an actual physical connection between the two different metals, for example, via a metal wire. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin.

The metal that is less noble, compared to the other metal, will dissolve in the electrolyte. The less noble metal is often referred to as the anode, and the more noble metal is often referred to as the cathode. Galvanic corrosion is an electrochemical process whereby free ions in the electrolyte make the electrolyte electrically conductive, thereby providing a means for ion migration from the anode to the cathode—resulting in deposition formed on the cathode. Metals can be arranged in a galvanic series. The galvanic series lists metals in order of the most noble to the least noble. An anodic index lists the electrochemical voltage (V) that develops between a metal and a standard reference electrode (gold (Au)) in a given electrolyte. The actual electrolyte used can affect where a particular metal or metal alloy appears on the galvanic series and can also affect the electrochemical voltage. For example, the dissolved oxygen content in the electrolyte can dictate where the metal or metal alloy appears on the galvanic series and the metal's electrochemical voltage. The anodic index of gold is −0 V; while the anodic index of beryllium is −1.85 V. A metal that has an anodic index greater than another metal is more noble than the other metal and will function as the cathode. Conversely, the metal that has an anodic index less than another metal is less noble and functions as the anode. In order to determine the relative voltage between two different metals, the anodic index of the lesser noble metal is subtracted from the other metal's anodic index, resulting in a positive value.

It has unexpectedly been discovered that a single metal alloy can dissolve via galvanic corrosion in the presence of an electrolyte without a distinct cathode being present. It was thought that in order for galvanic corrosion to occur in a useful time period, a distinct anode and cathode were required. Surprisingly, it has been discovered that a metal or metal alloy of certain metals can dissolve in an electrolyte. This unexpected discovery means that less complicated isolation devices can be made because a distinct cathode material is not required. Our testing has shown that a solid solution, as opposed to a partial solution, of alloying elements can be made to galvanically-corrode in such a way as to be useful as a dissolving material. The metal alloy can be made to balance certain desired properties, such as a desired strength of the isolation device and a desired rate of galvanic corrosion.

According to an embodiment, at least a portion of a wellbore isolation device consists essentially of: a metal alloy, wherein the ingredients making up the metal alloy are in solid solution, and wherein the metal alloy: (A) comprises magnesium at a concentration of at least 50% by volume of the metal alloy; and (B) at least partially dissolves in the presence of an electrolyte.

According to another embodiment, a method of removing the wellbore isolation device comprises: contacting or allowing the wellbore isolation device to come in contact with an electrolyte; and allowing at least a portion of the metal alloy to dissolve.

Any discussion of the embodiments regarding the isolation device or any component related to the isolation device (e.g., the electrolyte) is intended to apply to all of the apparatus and method embodiments.

Turning to the Figures, FIG. 1 depicts a well system 10. The well system 10 can include at least one wellbore 11. The wellbore 11 can penetrate a subterranean formation 20. The subterranean formation 20 can be a portion of a reservoir or adjacent to a reservoir. The wellbore 11 can include a casing 12. The wellbore 11 can include only a generally vertical wellbore section or can include only a generally horizontal wellbore section. A tubing string 15 can be installed in the wellbore 11. The well system 10 can comprise at least a first wellbore interval 13 and a second wellbore interval 14. The well system 10 can also include more than two wellbore intervals, for example, the well system 10 can further include a third wellbore interval, a fourth wellbore interval, and so on. At least one wellbore interval can correspond to a zone of the subterranean formation 20. The well system 10 can further include one or more packers 18. The packers 18 can be used in addition to the isolation device to create the wellbore interval and isolate each zone of the subterranean formation 20. The isolation device can be the packers 18. The packers 18 can be used to prevent fluid flow between one or more wellbore intervals (e.g., between the first wellbore interval 13 and the second wellbore interval 14) via an annulus 19. The tubing string 15 can also include one or more ports 17. One or more ports 17 can be located in each wellbore interval. Moreover, not every wellbore interval needs to include one or more ports 17. For example, the first wellbore interval 13 can include one or more ports 17, while the second wellbore interval 14 does not contain a port. In this manner, fluid flow into the annulus 19 for a particular wellbore interval can be selected based on the specific oil or gas operation.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 18 to aid the isolation device in providing zonal isolation. Cement may also be used in addition to packers 18.

According to an embodiment, the isolation device is capable of restricting or preventing fluid flow between a first wellbore interval 13 and a second wellbore interval 14. The first wellbore interval 13 can be located upstream or downstream of the second wellbore interval 14. In this manner, depending on the oil or gas operation, fluid is restricted or prevented from flowing downstream or upstream into the second wellbore interval 14. Examples of isolation devices capable of restricting or preventing fluid flow between zones include, but are not limited to, a ball and seat, a plug, a bridge plug, a wiper plug, a packer, and a plug in a base pipe. A detailed discussion of using a plug in a base pipe can be found in U.S. Pat. No. 7,699,101 issued to Michael L. Fripp, Haoyue Zhang, Luke W. Holderman, Deborah Fripp, Ashok K. Santra, and Anindya Ghosh on Apr. 20, 2010 and is incorporated herein in its entirety for all purposes. If there is any conflict in the usage of a word or phrase herein and any paper incorporated by reference, the definitions contained herein control.

As depicted in the drawings, the isolation device can be a ball 30 (e.g., a first ball 31 or a second ball 32) and a seat 40 (e.g., a first seat 41 or a second seat 42). The ball 30 can engage the seat 40. The seat 40 can be located on the inside of a tubing string 15. The inner diameter (I.D.) of the first seat 41 can be less than the I.D. of the second seat 42. In this manner, a first ball 31 can be dropped or flowed into wellbore. The first ball 31 can have a smaller outer diameter (O.D.) than the second ball 32. The first ball 31 can engage the first seat 41. Fluid can now be temporarily restricted or prevented from flowing into any wellbore intervals located downstream of the first wellbore interval 13. In the event it is desirable to temporarily restrict or prevent fluid flow into any wellbore intervals located downstream of the second wellbore interval 14, then the second ball 32 can be dropped or flowed into the wellbore and will be prevented from falling past the second seat 42 because the second ball 32 has a larger O.D. than the I.D. of the second seat 42. The second ball 32 can engage the second seat 42. The ball (whether it be a first ball 31 or a second ball 32) can engage a sliding sleeve 16 during placement. This engagement with the sliding sleeve 16 can cause the sliding sleeve to move; thus, opening a port 17 located adjacent to the seat. The port 17 can also be opened via a variety of other mechanisms instead of a ball. The use of other mechanisms may be advantageous when the isolation device is not a ball. After placement of the isolation device, fluid can be flowed from, or into, the subterranean formation 20 via one or more opened ports 17 located within a particular wellbore interval. As such, a fluid can be produced from the subterranean formation 20 or injected into the formation.

Figure 2:
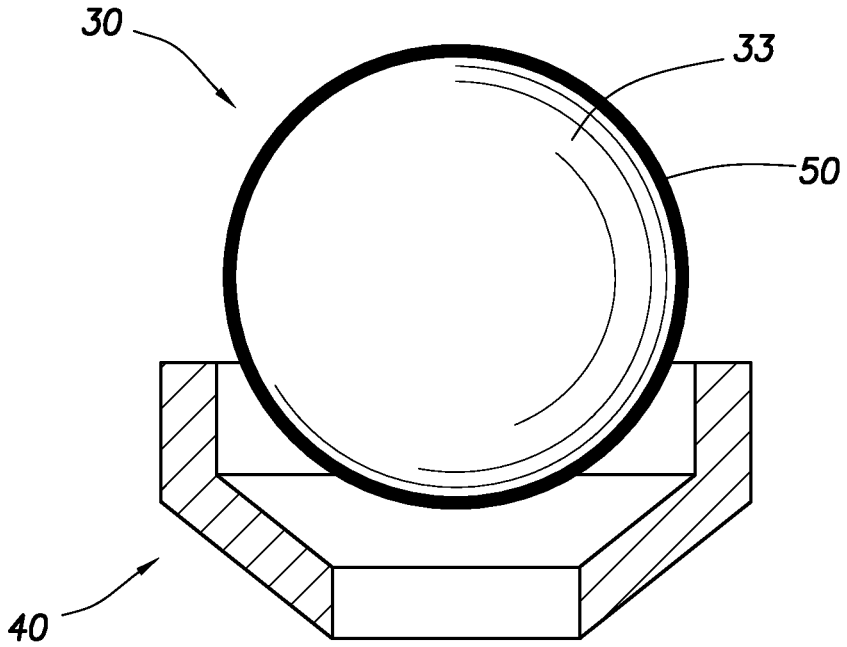
FIG. 2 depicts an isolation device according to an embodiment.

Referring to FIG. 2, at least a portion of the isolation device consists essentially of a metal alloy 33. The metal alloy 33 can be the mandrel of a packer or plug, a spacer ring, a slip, a wedge, a retainer ring, an extrusion limiter or backup shoe, a mule shoe, a ball, a flapper, a ball seat, a sleeve, or any other downhole tool or component of a downhole tool used for zonal isolation. The metal alloy 33 comprises magnesium as the metal. The magnesium is at a concentration of at least 50% by volume of the metal alloy. According to an embodiment, the magnesium is at a concentration in the range of about 70% to about 98%, preferably about 80% to about 95%, by volume of the metal alloy. The metal alloy comprises at least one other ingredient besides the magnesium. The at least one other ingredient can be selected from one or more metals, one or more non-metals, or combinations thereof. The one or more metals can be selected from the group consisting of lithium, sodium, potassium, rubidium, cesium, beryllium, calcium, strontium, barium, radium, aluminum, gallium, indium, tin, thallium, lead, bismuth, scandium, titanium, vanadium, chromium, manganese, thorium, iron, cobalt, nickel, copper, zinc, yttrium, zirconium, niobium, molybdenum, ruthenium, rhodium, palladium, praseodymium, silver, cadmium, lanthanum, hafnium, tantalum, tungsten, terbium, rhenium, osmium, iridium, platinum, gold, neodymium, gadolinium, erbium, oxides of any of the foregoing, and any combinations thereof. Preferably, the one or more metals is selected from the group consisting of lithium, beryllium, calcium, aluminum, tin, bismuth, scandium, chromium, manganese, thorium, nickel, copper, zinc, yttrium, zirconium, praseodymium, silver, cadmium, terbium, neodymium, gadolinium, erbium, oxides of any of the foregoing, and any combinations thereof. According to an embodiment, the one or more metals is neither radioactive nor unstable. The metal alloy can also contain the magnesium and the one or more non-metals. The one or more non-metals can be selected from the group consisting of graphite, carbon, silicon, boron nitride, and combinations thereof. The carbon can be in the form of carbon particles, fibers, nanotubes, or fullerenes. The graphite can be in the form of particles, fibers, or grapheme. The magnesium and the at least one other ingredient are in a solid solution and not in a partial solution or a compound where inter-granular inclusions may be present. Preferably, the magnesium and the at least one other ingredient are uniformly distributed throughout the metal alloy. It is to be understood that some minor variations in the distribution of particles of the magnesium and the at least one other ingredient can occur, but that it is preferred that the distribution is such that a homogenous solid solution of the metal alloy occurs. A solid solution is a solid-state solution of one or more solutes in a solvent. Such a mixture is considered a solution rather than a compound when the crystal structure of the solvent remains unchanged by addition of the solutes, and when the mixture remains in a single homogeneous phase.

The at least one other ingredient of the metal alloy can be selected such that the metal alloy has desired characteristics. Some of the desired characteristics include strength, precipitation hardening, dimensional stability and creep resistance, density, standard state reduction potential, combustibility, and rate of corrosion.

According to an embodiment, at least the metal alloy 33 is capable of withstanding a specific pressure differential for a desired amount of time. As used herein, the term "withstanding" means that the substance does not crack, break, or collapse. The pressure differential can be the downhole pressure of the subterranean formation 20 across the device. As used herein, the term "downhole" means the location of the wellbore where the metal alloy 33 is located. Formation pressures can range from about 1,000 to about 30,000 pounds force per square inch (psi) (about 6.9 to about 206.8 megapascals "MPa"). The pressure differential can also be created during oil or gas operations. For example, a fluid, when introduced into the wellbore 11 upstream or downstream of the substance, can create a higher pressure above or below, respectively, of the isolation device. Pressure differentials can range from 100 to over 10,000 psi (about 0.7 to over 68.9 MPa). According to an embodiment, the pressure differential is in the range from about 100 to about 12,000 psi (about 0.7 to about 83 MPa). According to another embodiment, the isolation device is capable of withstanding the specific pressure differential for the desired amount of time. The desired amount of time can be at least 30 minutes. The desired amount of time can also be in the range of about 30 minutes to 14 days, preferably 30 minutes to 2 days, more preferably 12 hours to 24 hours. The inclusion of aluminum, zinc, zirconium, and/or thorium can promote precipitation hardening and strengthen the metal alloy 33.

Inclusion of zirconium, neodymium, gadolinium, scandium, erbium, thorium, and/or yttrium increases the dimensional stability and creep resistance of the metal alloy 33, especially at higher temperatures. Silicon can reduce the creep resistance because the silicon forms fine, hard particles of $Mg_2Si$ along the grain boundaries, which helps to retard the grain-boundary sliding.

According to an embodiment, the metal alloy 33 has a desired density. The at least one other ingredient of the metal alloy 33 can be selected such that the metal alloy has the desired density. By way of example, the inclusion of lithium reduces the density of the metal alloy.

According to an embodiment, the metal alloy 33 has a desired standard state reduction potential. The following is a partial list of standard state reduction potential for some metals. Magnesium has a reduction potential of −2.375. The inclusion of metals having a greater reduction potential, such as potassium or calcium could increase the overall reduction potential of the metal alloy. The inclusion of metals having a lower reduction potential, such as aluminum or manganese could decrease the overall reduction potential. As can be seen, the at least one other ingredient of the metal alloy and their relative concentrations or ratios can be selected to provide the desired reduction potential. The standard state reduction potential can play a very important role in determining the reaction rate of the metal alloy in the electrolyte.

| Half-Reaction | $E^o_{red}$ |
|---|---|
| $K^+ + e^- \rightleftharpoons K$ | −2.924 |
| $Ba^{2+} + 2\,e^- \rightleftharpoons Ba$ | −2.90 |
| $Ca^{2+} + 2\,e^- \rightleftharpoons Ca$ | −2.76 |
| $Na^+ + e^- \rightleftharpoons Na$ | −2.7109 |
| $Mg^{2+} + 2\,e^- \rightleftharpoons Mg$ | −2.375 |
| $H_2 + 2\,e^- \rightleftharpoons 2\,H^-$ | −2.23 |
| $Al^{3+} + 3\,e^- \rightleftharpoons Al$ | −1.706 |
| $Mn^{2+} + 2\,e^- \rightleftharpoons Mn$ | −1.04 |
| $Zn^{2+} + 2\,e^- \rightleftharpoons Zn$ | −0.7628 |
| $Cr^{3+} + 3\,e^- \rightleftharpoons Cr$ | −0.74 |
| $S + 2\,e^- \rightleftharpoons S^{2-}$ | −0.508 |
| $2\,CO_2 + 2\,H^+ + 2\,e^- \rightleftharpoons H_2C_2O_4$ | −0.49 |
| $Cr^{3+} + e^- \rightleftharpoons Cr^{2+}$ | −0.41 |
| $Fe^{2+} + 2\,e^- \rightleftharpoons Fe$ | −0.409 |
| $Co^{2+} + 2\,e^- \rightleftharpoons Co$ | −0.28 |
| $Ni^{2+} + 2\,e^- \rightleftharpoons Ni$ | −0.23 |
| $Sn^{2+} + 2\,e^- \rightleftharpoons Sn$ | −0.1364 |
| $Pb^{2+} + 2\,e^- \rightleftharpoons Pb$ | −0.1263 |
| $Fe^{3+} + 3\,e^- \rightleftharpoons Fe$ | −0.036 |

The at least one other ingredient of the metal alloy can also be selected to help decrease the combustibility of the metal alloy 33. By way of example, the inclusion of calcium can help decrease the combustibility of the metal alloy.

The metal alloy 33 at least partially dissolves in the presence of an electrolyte. As used herein, an electrolyte is any substance containing free ions (i.e., a positively or negatively charged atom or group of atoms) that make the substance electrically conductive. The electrolyte can be selected from the group consisting of, solutions of an acid, a base, a salt, and combinations thereof. A salt can be dissolved in water, for example, to create a salt solution. Common free ions in an electrolyte include sodium ($Na^+$), potassium ($K^+$), calcium ($Ca^{2+}$), magnesium ($Mg^{2+}$), chloride ($Cl^-$), hydrogen phosphate ($HPO_4^{2-}$), and hydrogen carbonate ($HCO_3^-$). Preferably, the electrolyte contains chloride ions. The electrolyte can be a fluid that is introduced into the wellbore or a reservoir fluid.

According to an embodiment, the metal alloy 33 dissolves in a desired amount of time. The desired amount of time can be selected based on the specific oil or gas operation to be performed. The desired amount of time can be in the range from about 1 hour to about 2 months, preferably about 5 to about 10 days. Some of the factors that can affect the rate of dissolution include the reduction potential of the metal alloy, the remaining ingredients in the metal alloy, and the concentration of the electrolyte. According to an embodiment, the other ingredients of the metal alloy are selected such that the metal alloy has a desired rate of dissolution. By way of example, beryllium, cerium, praseodymium, thorium, yttrium, neodymium, terbium, gadolinium, and zirconium can be included in the metal alloy to reduce the reaction rate. Small additions of manganese (approximately 0.2% by volume of the metal alloy) tends to reduce the reaction rate because the manganese reacts with iron impurities to form non-reactive, inter-metallic compounds. Calcium, cadmium, silver, and zinc have a moderate accelerating effect on the corrosion rate, while cobalt, copper, iron, silver, and nickel have significant accelerating effects. Aluminum, manganese, sodium, silicon, lead, and tin tend to have a minimal effect on the dissolution rate of the metal alloy. Some of these ingredients can help to moderate the effects from other ingredients. For example, manganese alone has a minimal effect on the dissolution rate, but can help to minimize or counter balance the effects of iron on the dissolution rate.

Another factor that can affect the rate of dissolution of the metal alloy 33 is the concentration of the electrolyte and the temperature of the electrolyte. Generally, the higher the concentration of the electrolyte, the faster the rate of dissolution of the metal alloy 33, and the lower the concentration of the electrolyte, the slower the rate of dissolution. Moreover, the higher the temperature of the electrolyte, the faster the rate of dissolution of the metal alloy 33, and the lower the temperature of the electrolyte, the slower the rate of dissolution. The concentration (i.e., the total number of free ions available in the electrolyte) of the electrolyte can be adjusted to control the rate of dissolution of the metal alloy 33. According to an embodiment, the concentration of the electrolyte is selected such that the at least a portion of the metal alloy 33 dissolves in the desired amount of time. If more than one electrolyte is used, then the concentration of the electrolytes is selected such that the metal alloy 33 dissolves in a desired amount of time. The concentration can be determined based on at least the specific metals or non-metals used and the bottomhole temperature of the well. Moreover, because the free ions in the electrolyte enable the galvanic corrosion of the metal alloy by donating its free ions, the number of free ions will decrease as the reaction occurs. At some point, the electrolyte may be depleted of free ions if there is any remaining metal alloy 33 that has not reacted. If this occurs, the galvanic corrosion that causes the metal alloy 33 to dissolve will stop. In this example, it may be necessary to cause or allow the metal alloy 33 to come in contact with a second, third, or fourth, and so on, electrolyte(s).

The pH of the electrolyte can also play a role in the reaction rate of the metal alloy 33. For example, magnesium goes into a passivation state when in a fluid having a pH greater than about 11.5. However, magnesium will dissolve in the electrolyte at pH values less than about 11.5. According to an embodiment, the pH of the electrolyte is selected such that the metal alloy 33 dissolves in the desired amount of time. The pH of the electrolyte can be less than about 11.5, preferably less than 7.

It may be desirable to delay contact of the metal alloy 33 with the electrolyte. The metal alloy 33 can further include a coating 50 fully or partially enveloping the outside of the metal alloy 33. The coating 50 can be a compound, such as a wax, thermoplastic, sugar, salt, or polymer. The coating 50 can be selected such that the coating either dissolves in wellbore fluids or melts at a certain temperature. Upon dissolution or melting, the metal alloy 33 of the isolation device 30 is available to come in contact with the electrolyte.

A metal alloy can be susceptible to age hardening. In age hardening, the properties of the metal alloy change slowly over time. This can be quite problematic when the isolation device is stored prior to use for an extended period of time. The metal alloy can be manufactured by a process that reduces or eliminates age hardening. For example, the metal alloy can be made using a heat treatment technique. One example of heat treatment involves precipitation heat treatment where the alloy is heated to allow the precipitation of the constituent ingredients that are held in a solid solution. The precipitation heat treatment temperature can be in the range from 300° F. to 500° F. (149° C. to 260° C.) for 1 to 16 hours. For example, a forged metal alloy can be heated for 24 hours at 350° F. (177° C.). In another example, cast parts are heated for 1 to 2 hours at 400° F. to 500° F. (204° C. to 260° C.), followed by slow cooling. The precipitation heat treatment could follow a solution heat treatment. A solution heat treatment involves heating the metal alloy to a temperature at which certain ingredients of the alloy go into solution, and then quenching so as to hold these ingredients in solution during cooling. The solution heat treatment temperature can be in the range from 650° F. to 1050° F. (343° C. to 566° C.) for 10 to 24 hours. Other manufacturing techniques that can be utilized include casting, forging, or sintering.

According to an embodiment, at least the metal alloy 33 includes one or more tracers (not shown). The tracer(s) can be, without limitation, radioactive, chemical, electronic, or acoustic. A tracer can be useful in determining real-time information on the rate of dissolution of the metal alloy 33. By being able to monitor the presence of the tracer, workers at the surface can make on-the-fly decisions that can affect the rate of dissolution of the remaining metal alloy 33.

The methods include the step of contacting or allowing the wellbore isolation device to come in contact with the electrolyte. The step of contacting can include introducing the electrolyte into the wellbore. The step of allowing can include allowing the isolation device to come in contact with a fluid, such as a reservoir fluid. The methods can include contacting or allowing the device to come in contact with two or more electrolytes. If more than one electrolyte is used, the free ions in each electrolyte can be the same or different. A first electrolyte can be, for example, a stronger electrolyte compared to a second electrolyte. Furthermore, the concentration of each electrolyte can be the same or different. It is to be understood that when discussing the concentration of an electrolyte, it is meant to be a concentration prior to contact with the metal alloy 33, as the concentration will decrease during the galvanic corrosion reaction. Tracers can be used to help determine the necessary concentration of the electrolyte to help control the rate and finality of dissolution of the metal alloy 33.

The methods can further include the step of placing the isolation device in a portion of the wellbore 11, wherein the step of placing is performed prior to the step of contacting or allowing the isolation device to come in contact with the electrolyte. More than one isolation device can also be placed in multiple portions of the wellbore. The methods can further include the step of removing all or a portion of the dissolved metal alloy 33 and/or all or a portion of the isolation device, wherein the step of removing is performed after the step of allowing the at least a portion of the metal alloy 33 to dissolve. The step of removing can include flowing the dissolved metal alloy 33 and/or the isolation device from the wellbore 11. According to an embodiment, a sufficient amount of the metal alloy 33 dissolves such that the isolation device is capable of being flowed from the wellbore 11. According to this embodiment, the isolation device should be capable of being flowed from the wellbore via dissolution of the metal alloy 33, without the use of a milling apparatus, retrieval apparatus, or other such apparatus commonly used to remove isolation devices.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of removing a wellbore isolation device comprising:

contacting or allowing the wellbore isolation device to come in contact with an electrolyte, wherein at least a portion of the wellbore isolation device consists essentially of a metal alloy, wherein the ingredients making up the metal alloy are in solid solution consisting of a single homogenous phase, wherein the metal alloy:

(A) comprises magnesium at a concentration of at least 50% by volume of the metal alloy;

(B) is alloyed with nickel; and (C) at least partially dissolves in the presence of the electrolyte; and allowing at least a portion of the metal alloy to dissolve.

2. The method according to claim 1, wherein the isolation device is capable of restricting or preventing fluid flow between a first wellbore interval and a second wellbore interval.

3. The method according to claim 1, wherein isolation device is a ball and a seat, a plug, a bridge plug, a wiper plug, or a packer.

4. The method according to claim 1, wherein the metal alloy is the mandrel of a packer or plug, a spacer ring, a slip, a wedge, a retainer ring, an extrusion limiter or backup shoe, a mule shoe, a ball, a flapper, a ball seat, a sleeve, or any other downhole tool or component of a downhole tool used for zonal isolation.

5. The method according to claim 1, wherein the magnesium is at a concentration in the range of about 70% to about 98% by volume of the metal alloy.

6. The method according to claim 1, wherein the metal alloy comprises at least one other ingredient in addition to the magnesium, and wherein the at least one other ingredient is selected from one or more metals, one or more non-metals, or combinations thereof.

7. The method according to claim 6, wherein the one or more metals is selected from the group consisting of lithium, beryllium, calcium, aluminum, tin, bismuth, scandium, chromium, manganese, thorium, nickel, copper, zinc, yttrium, zirconium, praseodymium, silver, cadmium, terbium, neodymium, gadolinium, erbium, oxides of any of the foregoing, and any combinations thereof.

8. The method according to claim 6, wherein the one or more non-metals is selected from the group consisting of graphite, carbon, silicon, boron nitride, and combinations thereof.

9. The method according to claim 6, wherein the isolation device is capable of withstanding a specific pressure differential.

10. The method according to claim 6, wherein the metal alloy has a desired density, and wherein the at least one other ingredient is selected such that the metal alloy has the desired density.

11. The method according to claim 6, wherein the metal alloy has a desired standard state reduction potential, and wherein the at least one other ingredient is selected and for more than one other ingredient, the ingredient's relative concentrations or ratios are selected to provide the desired standard state reduction potential.

12. The method according to claim 6, wherein at least the portion of the metal alloy dissolves in a desired amount of time.

13. The method according to claim 12, wherein the at least one other ingredient is selected such that the metal alloy has a desired rate of dissolution and dissolves in the desired amount of time.

14. The method according to claim 12, wherein the pH of the electrolyte is selected such that at least the portion of the metal alloy dissolves in the desired amount of time.

15. The method according to claim 1, wherein the electrolyte is selected from the group consisting of solutions of an acid, a base, a salt, and combinations thereof.

16. The method according to claim 1, further comprising introducing the electrolyte into the wellbore.

17. The method according to claim 1, further comprising the step of placing the isolation device into a portion of the wellbore, wherein the step of placing is performed prior to the step of contacting or allowing the isolation device to come in contact with the electrolyte.

18. The method of claim 1, wherein the metal alloy is not coated.

19. At least a portion of a wellbore isolation device consists essentially of:

a metal alloy, wherein the ingredients making up the metal alloy are in solid solution consisting of a single homogenous phase, wherein the metal alloy is not coated, and wherein the metal alloy:

(A) comprises magnesium at a concentration of at least 50% by volume of the metal alloy;

(B) is alloyed with nickel;

(C) at least partially dissolves in the presence of an electrolyte; and (D) has been heat treated at a temperature in the range of 300° F. to 500° F. for 1 to 24 hours.

* * * * *